US005833535A

United States Patent [19]

Williams

[11] Patent Number: 5,833,535

[45] Date of Patent: Nov. 10, 1998

[54] ANTERIOR TIBIALIS EXERCISE MACHINE

[76] Inventor: Ron D. Williams, Williams Gym Equipment, 1651 Funston-Sale City Rd., Moultrie, Ga. 31768

[21] Appl. No.: 907,645

[22] Filed: Aug. 11, 1997

Related U.S. Application Data

[60] Provisional application No. 60/023,856 Aug. 13, 1996.

[51] Int. Cl.[6] ..... A63B 23/08; A63B 21/06

[52] U.S. Cl. ..... 482/80; 482/100; 482/137

[58] Field of Search ..... 482/79, 80, 97, 482/100, 131, 133, 137

[56] References Cited

U.S. PATENT DOCUMENTS

| | | | |
|---|---|---|---|
| 2,542,074 | 2/1951 | Bierman . | |
| 3,120,954 | 2/1964 | Apostol . | |
| 3,863,916 | 2/1975 | Cline . | |
| 4,239,210 | 12/1980 | Lambert, Jr. | 482/100 |
| 4,591,149 | 5/1986 | Godfrey . | |
| 4,807,874 | 2/1989 | Little | 482/80 |
| 4,813,666 | 3/1989 | Costilow et al. | 482/80 |
| 4,883,270 | 11/1989 | Maag | 482/80 X |
| 4,930,768 | 6/1990 | Lapcevic . | |
| 5,183,452 | 2/1993 | Bacon et al. | 482/80 X |
| 5,356,360 | 10/1994 | Johns . | |
| 5,478,296 | 12/1995 | Lee | 482/131 |
| 5,487,711 | 1/1996 | Little | 482/79 |

FOREIGN PATENT DOCUMENTS

| | | |
|---|---|---|
| 614683 (A1) | 9/1994 | European Pat. Off. . |
| 2303970 | 2/1974 | Germany . |

*Primary Examiner*—John Mulcahy
*Attorney, Agent, or Firm*—Richard C. Litman

[57] ABSTRACT

An exercise machine for exercising the muscles of the front of the lower leg. The exercise machine includes a frame that supports a seat and a pivot shaft such that a user seated on the seat can rest his heels on the pivot shaft. An exercise arm is fixedly attached to the pivot shaft such that pivoting of the exercise arm causes rotation of the pivot shaft. An exercise bar which is parallel to the pivot shaft is attached to the exercise arm, and is spaced from the pivot shaft such that the user can slide the tops of his feet under the exercise bar with his heels resting on the pivot shaft. A cable and pulley system connect the pivot shaft to a stack of weights to thereby provide resistance to the pivoting of the foot about the heels. A hand lever linked to the pivot shaft raises the arm to allow the user to more easily position the tops of the feet under the bar.

11 Claims, 4 Drawing Sheets

ANTERIOR TIBIALIS EXERCISE MACHINE

CROSS-REFERENCE TO RELATED APPLICATION

This application claims the benefit of U.S. Provisional Patent application Ser. No. 60/023,856, filed Aug. 13, 1996.

BACKGROUND OF THE INVENTION

1. Field of the Invention

The present invention relates to an exercise machine for exercising the muscles in the front of the lower leg.

2. Description of the Related Art

The key to total physical fitness is to adequately exercise all the muscles of the body. A tour of most gyms will reveal that although there are a myriad of machines for exercising the major muscle groups, certain muscle groups are entirely neglected. This lack of proper equipment is particularly true for exercising the muscles of the front of the lower leg, also known as the anterior tibialis muscles.

Heretofore, persons interested in exercising the anterior tibialis muscles have had to improvise, obtaining less than satisfactory results because of a lack of exercise machines specifically designed for exercising the anterior tibialis muscles. One improvised technique is to hang from a chin-up bar by one's toes. The dangers of such a maneuver should be readily apparent. First, the resistance cannot be varied because the resistance is dictated by body weight. Therefore, the person does not have the opportunity to gradually build up the strength in his anterior tibialis muscles, before attempting an exercise having a resistance level that could overwhelm his anterior tibialis muscles and thus cause those muscles to be strained or injured. Second, falling from the bar while hanging upside-down could cause extremely serious injuries to the head and spinal column.

Other improvised techniques include using a leg extension machine to exercise the anterior tibialis muscles. This technique involves attempting to raise the exercise arm by one's toes while holding the heels stationary in midair. This technique does not allow for the proper isolation of the anterior tibialis muscles during the exercise, i.e. does not allow solely the use of the anterior tibialis muscles during the exercise, because the heels are not supported. Further, this technique results in tremendous strain on the knee joints, which may lead to injury. Although many exercise machines are known in the related art, none of the related art machines show the unique structural features of the present invention which make the present invention particularly suited for exercising the anterior tibialis muscles.

U.S. Pat. No. 2,542,074, issued to William Bierman on Feb. 20, 1951, shows an exercising and measuring instrument for the carpal-tarsal joints which allows for limited exercising of the anterior tibialis muscles of paralyzed patients. The machine of Bierman lacks the frame work to allow the level of exercise intensity required by athletes. Further, the Bierman device lacks the cam and exercise arm arrangement of the present invention.

U.S. Pat. No. 3,120,954, issued to Chris J. Apostol on Feb. 11, 1964, shows an exercise machine for allowing the exercising of the anterior tibialis muscles. The machine of Apostol lacks any support for the heels while exercising the anterior tibialis muscles.

U.S. Pat. No. 3,864,916, issued to Vance Allen Cline on Feb. 4, 1975, shows an exercise machine for allowing the exercising of the anterior tibialis muscles. The machine of Cline lacks the integral adjustable seat of the present invention. Further, the Cline device lacks the cam and exercise arm arrangement of the present invention.

U.S. Pat. No. 4,591,149, issued to Daniel R. Godfrey on May 27, 1986, shows an exercise machine for exercising the anterior tibialis muscles. The bar lifted by the toes in the machine of Godfrey moves linearly rather than in an arc. Therefore, the bar of the Godfrey apparatus moves relative to the tops of the feet which may result in some discomfort. Further, the Godfrey device lacks the cam and exercise arm arrangement of the present invention.

U.S. Pat. No. 4,930,768, issued to Thomas G. Lapcevic on Jun. 5, 1990, and U.S. Pat. No. 5,356,360, issued to George Johns on Oct. 18, 1994, show variable resistance exercise machines for exercising the muscles of the thigh. The Lapcevic and the Johns machines are not designed for exercising the anterior tibialis muscles.

German Patent Document Number 2,303,970, by Lachar Royalty Management Corp. dated Feb. 7, 1974, shows an exercise machine having straps that fit around the feet. The straps are connected by cable to weights. Although the apparatus of German document '970 can also exercise the anterior tibialis muscles, the German '970 apparatus does not allow for the isolation of those muscles and the German '970 apparatus lacks any heel support.

European Patent Document Number 614,683(A1), by Jose Beistegui dated Feb. 7, 1974, shows a collapsible exercise machine for performing various exercises. However, the Beistegui apparatus is not designed for exercising the anterior tibialis muscles.

None of the above inventions and patents, taken either singly or in combination, is seen to describe the instant invention as claimed.

SUMMARY OF THE INVENTION

The present invention is directed to an exercise machine wherein a user in the seated position causes the rotation of a shaft by pivoting his feet to bring his toes toward his knees. The rotation of the shaft causes the taking up of a cable around a cam fixed to the shaft. The cable is routed around several pulleys and supports a stack of weights at an end thereof. Rotation of the shaft and consequent take-up of the cable around the cam, cause the lifting of the stack of weights, thus providing the resistance experienced during the performance of the exercise.

Accordingly, it is a principal object of the invention to provide an exercise machine for exercising the muscles of the front of the lower leg.

It is another object of the invention to provide an exercise machine, for exercising the muscles of the front of the lower leg, wherein the resistance experienced during the exercise can be varied by the user.

It is a further object of the invention to provide an exercise machine, for exercising the muscles of the front of the lower leg, that is comfortable and safe to use.

Still another object of the invention is to provide an exercise machine that allows a user to lift a weight by bringing the toes of each foot toward the respective knee, thus exercising the muscles of the front of the lower leg.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an exercise machine 10 which is particularly suited to exercising the anterior tibialis muscles. Contraction of the anterior tibialis muscle causes the foot to pivot about the ankle, bringing the toes toward the knee. Also, when a force is applied to the toes tending to stretch out the foot, i.e. tending to pivot the foot about the ankle away from the knee, the anterior tibialis muscles must generate tension to resist that force if the foot is not to pivot in an uncontrolled fashion.

Figure 1:
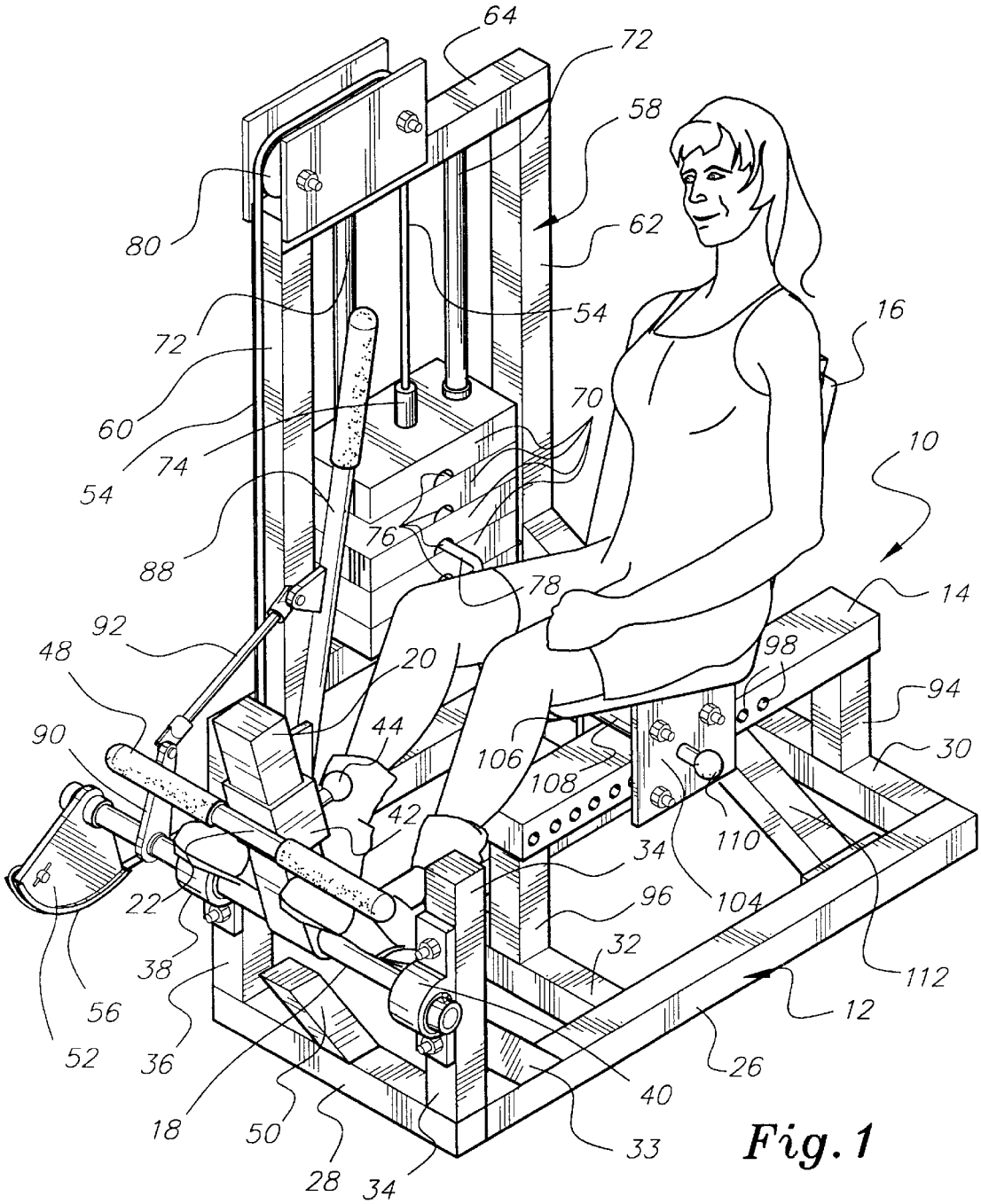
FIG. 1 is an environmental view showing a person using an exercise machine according to the present invention.
Figure 2:
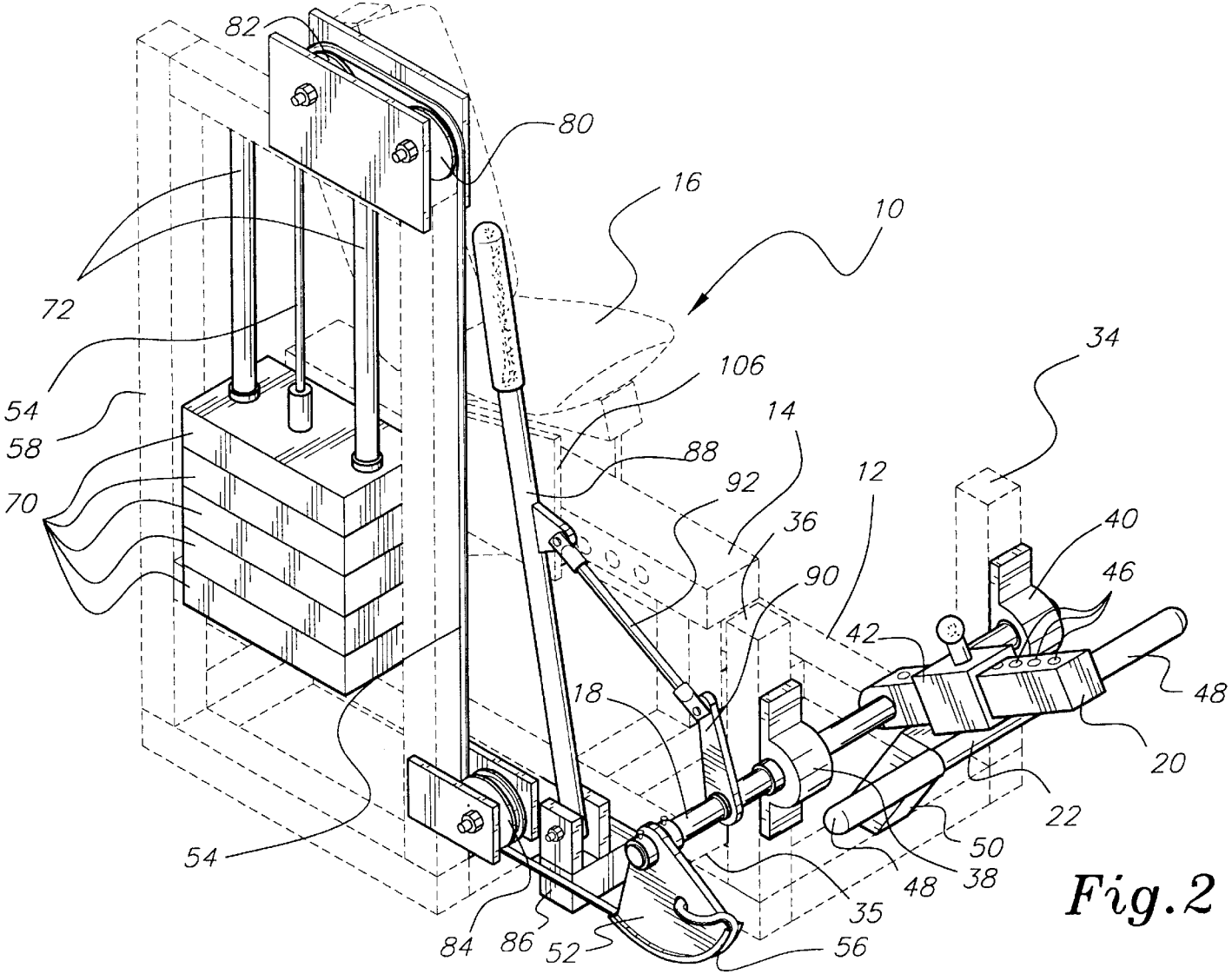
FIG. 2 is a fragmentary view showing the cam and pulley arrangement and the lever for positioning the exercise arm that is used in the exercise machine of the present invention.
Figure 3:
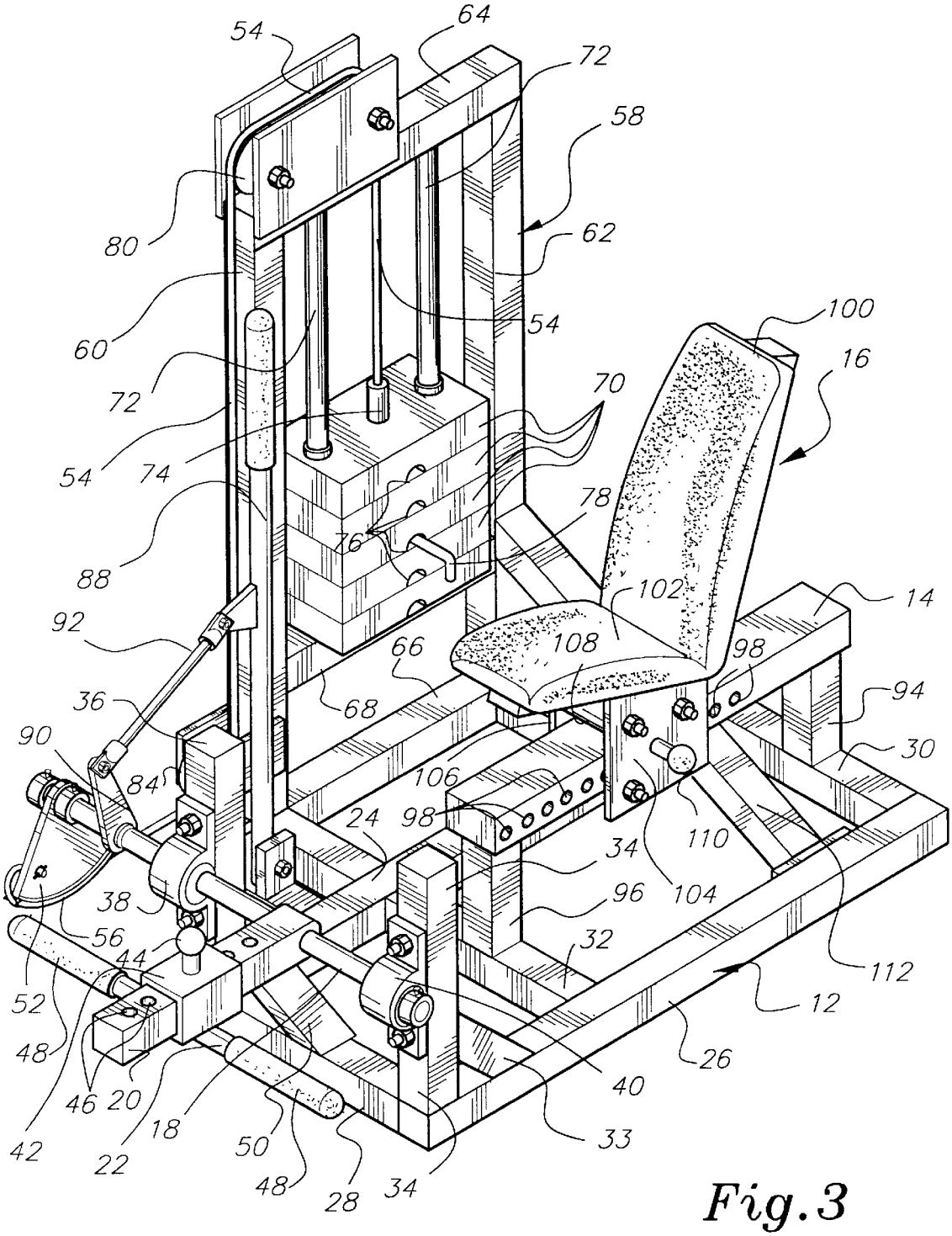
FIG. 3 is a perspective view of an exercise machine according to the present invention used for exercising the muscles of the front of the lower leg.

Referring to FIGS. 1–3, the exercise machine 10 includes a rectangular base frame 12, a seat support beam 14, a seat 16, a pivot shaft 18 connected by a cable and pulley system to a variable weight, an exercise arm 20 fixed to the pivot shaft 18, and an exercise bar 22 adjustably attached to and supported by the exercise arm 20. The base frame 12 has two parallel longer members 24 and 26. Two parallel shorter members 28 and 30 extend between the members 24 and 26 to form a rectangle. Another member 32 also extends between the members 24 and 26, intermediate the members 28 and 30. The member 32 is parallel to the members 28 and 30.

At one end of the base frame 12, two upright members 34 and 36 project orthogonally from each corner of the base frame 12. Bracing members 33 and 35 extend between the base frame 12 and the uprights 34 and 36 respectively. The bracing members 33 and 35 more rigidly fix the uprights 34 and 36 to the base frame 12. The upright members 34 and 36 support journal supports 40 and 38 respectively. The journal supports 40 and 38 have flanges that allow them to be bolted to the uprights 34 and 36. The journal supports 40 and 38 rotatably support the pivot shaft 18.

The pivot shaft 18 extends between the journal supports 40 and 38 and continues for some distance beyond the journal support 38.

The exercise arm 20 is fixedly attached to the pivot shaft 18 midway between the journal supports 40 and 38, such that the exercise arm 20 rotates with the shaft 18. The exercise arm 20 slidably supports a collar 42. A knob 44 is attached to a spring loaded pin (not shown) carried by the collar 42. The spring loaded pin carried by the collar 42 passes through the wall of the collar 42 and is engageable with the holes 46 distributed along the length of the exercise arm 20. Pulling the knob 44 outward disengages the spring loaded pin, carried by collar 42, from the holes 46 and allows the collar 42 to be slidably moved along the exercise arm 20. Once the spring loaded pin carried by collar 42 is in registry with a user selected one of the holes 46 the knob 44 is released to fix the location of the collar 42 along the exercise arm 20. The collar 42 is fixedly attached to the exercise bar 22 at about the middle of the exercise bar 22.

The exercise bar 22 is intended to be engaged by the tops of a user's feet, particularly by the area over the metatarsus bones adjacent to the toes and the area directly over the toes, while the user's heels rest on the pivot shaft 18. The exercise bar 22 has padded portions 48 on either side of the collar 42 to allow the user's feet to engage the exercise bar with greater comfort. Provision of the collar 42 allows the distance between the exercise bar 22 and the pivot shaft 18, to be adjusted to accommodate feet of various sizes. A pedestal 50 projects upward, in an inclined manner, from the base frame 12 and supports the exercise arm 20 in the resting state as illustrated in FIG. 3.

A cam 52 is fixedly attached to the end of the pivot shaft 18 which is distal from the journal support 40. Thus, rotation of the pivot shaft 18 causes the rotation of the cam 52. One end of a cable 54 is fixed to the cam 52 in the manner illustrated in the drawings. Along the outer rim of the cam 52 is a concave guide track 56. The guide track 56 ensures that the portion of the cable 54 in contact with the cam 52, will at all times follow the outline of the outer rim of the cam 52.

Located in proximity to one side of the base frame 12 is a rectangular weight stack support frame 58. The weight stack support frame 58 includes two uprights 60 and 62, a top member 64, and a bottom member 66. Another member 68 spans the distance between the members 60 and 62 at a height intermediate the bottom member 66 and the top member 64. The member 68 supports a stack of weights or plates 70 when the plates 70 are at rest. During exercise, the plates 70 not selected by the user remain atop the member 68. A pair of guide rods 72 extend between the top member 64 and the member 68. The guide rods 72 pass through the stack of weights 70 and confine the plates 70 to vertical movement only.

Each plate 70 has a central hole therein that is in registry with similar holes in all the other plates 70. Thus when the plates 70 are stacked one on top of another, a central passage is formed that passes through the entire stack. A lifter rod 74 fits in the passage through the stack of plates 70. Each plate 70 has a channel 76 formed in the bottom thereof. The channels 76 communicate with the vertical passage formed in the center of the stack of weights 70. The lifter rod 74 has a plurality of holes each of which is in registry with a respective channel 76 when the machine is in the resting or idle state illustrated in FIG. 3. A selector pin 78 is inserted through a selected channel 76 and engaged to the corresponding hole in the lifter rod 74 to select the plates 70 which are to be lifted during the exercise.

A pair of pulleys 80 and 82 are rotatably supported above the top member 64, and a pulley 84 is rotatably supported adjacent the upright 60 near the bottom member 66 (see FIG. 2). The cable 54, after coming off of the guide track 56, is routed under the pulley 84 and over the pulleys 80 and 82. Cable 54 is then routed through a hole (not shown) in the top member 64, and an end of the cable 54 is fixed to the lifter rod 74. When the exercise arm 20 is pivoted back toward the seat 16, the cam 52 is rotated and takes up more of the cable 54 thus pulling up on the lifter rod 74 via the cable 54. As the lifter rod 74 is raised, the selector pin 78 and the plates 70 above the pin 78 are also raised. Of course, the torque applied to the exercise arm 20 during the exercise must be sufficient to overcome the weight of the selected plates 70. Thus the resistance experienced by a user during exercise using the machine 10 is a function of the number of plates 70 above the pin 78, and can be varied by varying the location of the pin 78 along the vertical dimension of the stack of weights 70 at the beginning of the exercise.

Attached to the base frame member 24 proximate the upright 36 is a short frame extension 86. The frame extension 86 pivotally supports a lever 88. The lever 88 is linked to an arm 90 by a linking rod 92. The linking rod 92 is pivotally attached at both ends, and the arm 90 is fixed to the pivot shaft 18 such that the pivot shaft 18 rotates when the arm 90 is pivoted. It should be readily apparent from the illustrated construction that pulling back on the lever 88 will raise the exercise arm 20 from the pedestal 50 to allow the portion of the user's feet including the toes to more easily slip under the exercise bar 22 while keeping the heels on the pivot shaft 18.

Rising orthogonally from the members 30 and 32 are uprights 94 and 96, respectively. The uprights 94 and 96 support the seat support beam 14 at either end thereof. The seat support beam 14 has a plurality of horizontal, transverse holes 98 distributed along the length thereof. The seat 16 has a back 100 and a seat portion 102. Two parallel plates 104 and 106 extend vertically down from the bottom of the seat portion 102 and straddle the seat support beam 14 on either side. Four rollers 108 (only one shown) are horizontally supported between the two plates 104 and 106. Two of the four rollers 108 are positioned above the seat support beam 14 and two rollers are positioned below the seat support beam 14. The rollers 108 restrict the movement of the seat 16 to translational motion along the length of the seat support beam 14.

A knob 110, similar to knob 44, is attached to a spring loaded pin (not shown) carried by the plate 104. This spring loaded pin engages a selected one of the holes 98 to fix the position of the seat 16 along the length of the seat support beam 14. Thus knob 110 allows the distance between the seat 16 and the pivot shaft 18 to be adjusted to suit users of different sizes.

A bracing member 112 extends in an inclined manner between the upright 62 and the base frame member 26 to more rigidly fix the weight stack support frame 58 to the base frame 12. The bracing member 112 has flanges at one end that allow the bracing member 112 to be bolted to the base frame member 26.

Figure 4:
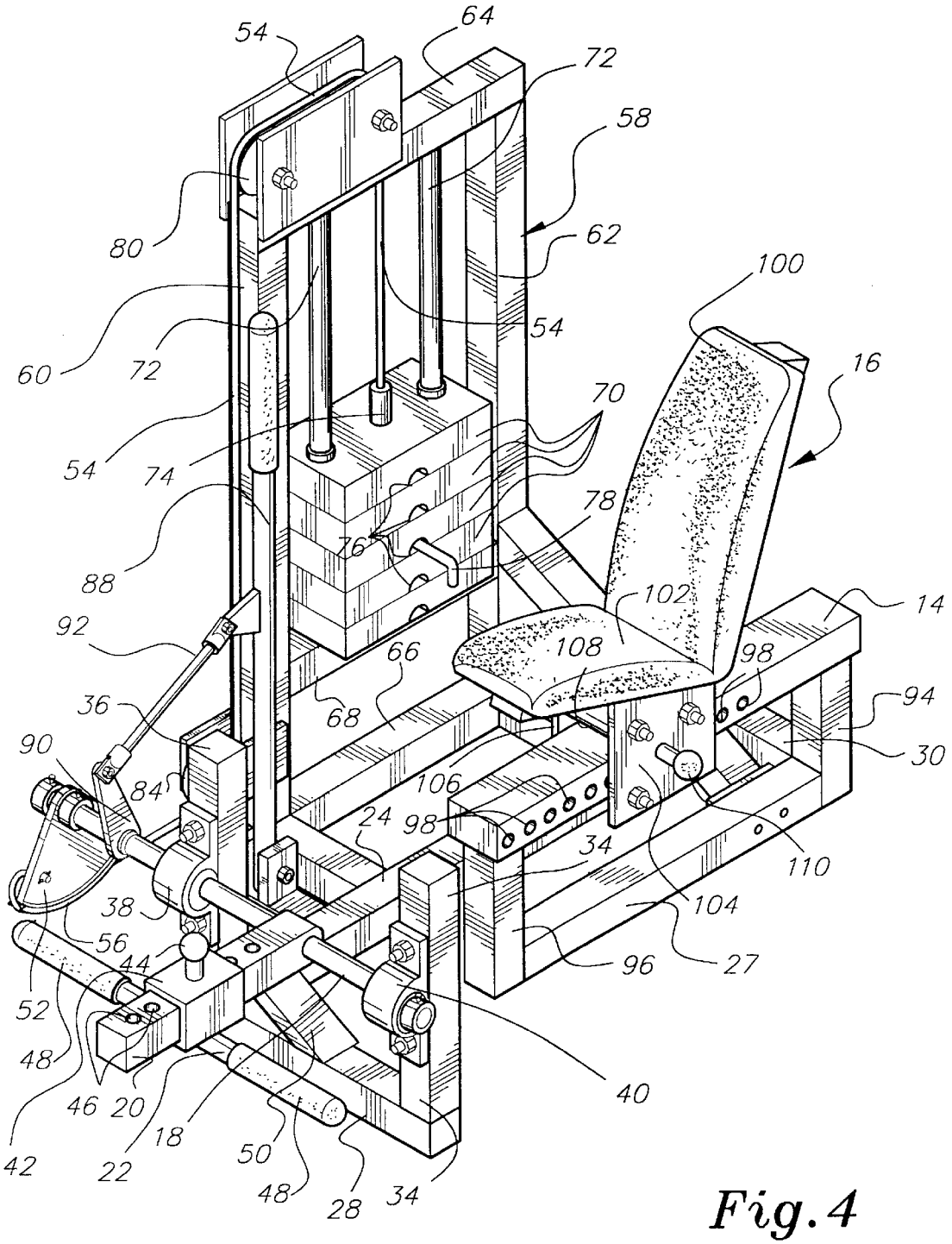
FIG. 4 is a perspective view of an exercise machine according to the present invention showing the preferred embodiment of the base frame.

FIG. 4 shows the preferred embodiment of the base frame 12 which requires less material to manufacture and therefore is less expensive to produce. In the preferred embodiment of the base frame 12 the base frame member 26, the bracing member 33, part of member 30, and part of member 32 are removed. A new base frame member 27 is added which extends between upright member 94 and upright member 96. The bracing member 112 extends in an inclined manner between the upright 62 and the base frame member 27 to more rigidly fix the weight stack support frame 58 to the base frame 12. The bracing member 112 has flanges at one end that allow the bracing member 112 to be bolted to the base frame member 27.

In use, a person wishing to exercise their anterior tibialis muscles using the exercise machine 10, assumes the seated position by sitting on the seat 16. The amount of the resistance to be overcome during the performance of the exercise, i.e. the weight lifted during each repetition, is selected by inserting the selector pin 78 in the bottom channel 76 of the lowest plate of the particular number of plates 70 that the user wishes to lift. Of course the location of the lowest plate, in the selected stack of plates 70 that are to be lifted, is determined by starting at the top of the stack of plates 70 and counting the plates while moving down the stack until the desired number is reached. Next using the knob 110 the user slidably adjusts the horizontal position of the seat 16 such that the user can rest his heels on the pivot shaft 18 while seated comfortably in the seat 16. The user then uses the lever 88 to move the exercise arm 20, from the resting position, to a position where the exercise bar 22 can be engaged by the tops of the user's feet near or over the toes. The user engages the exercise bar 22 by hooking his feet under the exercise bar, with the exercise bar located near or over the toe area and the heels resting on the pivot shaft 18.

Once the user's feet are properly positioned under the exercise bar 22, the lever 88 is released. The torque applied to the pivot shaft 18 by the stack of weights 70 above the selector pin 78, via the cable 54, must now be countered by the tension in the user's anterior tibialis muscles which function to move the user's toes toward the user's knees when contracted. By pivoting the feet about the heel, such that the toes are alternatingly brought closer to and moved away from the knees, the user causes the pivot shaft 18 to rotate back and forth. The back and forth rotation of the pivot shaft 18 causes the stack of plates 70 selected by the user to be raised and lowered respectively. To raise and lower the selected ones of the plates 70 in a slow controlled manner, the anterior tibialis muscles must constantly generate tension. Thus, the anterior tibialis muscles will be exercised both when raising and when lowering the selected ones of the plates 70.

After the completion of the exercise set, the user can again use the lever 88 to facilitate the removal of the feet from underneath the exercise bar 22. To facilitate the removal of the feet the lever 88 is grasped, pulled back slightly to lift the exercise bar 22 from the tops of the feet, and held at that position. In this condition the user's arm or arms bear the weight of the selected stack of plates 70, allowing the user's feet to be removed safely and easily from underneath the exercise bar 22.

It is to be understood that the present invention is not limited to the sole embodiment described above, but encompasses any and all embodiments within the scope of the following claims.

I claim:

1. An anterior tibialis muscle exercise machine, said exercise machine comprising:

a frame;

a seat supported by said frame;

a shaft rotatably supported by said frame;

a member affixed to and extending from said shaft;

an elongated member having a first end pivotally attached to said frame and an opposite second end including a handle for use by an exerciser seated in said seat, said elongated member being connected to said member so as to rotate said shaft upon pivoting of said elongated member by an exerciser;

an arm fixed to said shaft;

a bar attached to said arm, said bar having a portion parallel to and spaced apart from said shaft for a user to engage said bar with a top portion of a foot with the heel resting on said shaft; and means for providing a rotational resistance to said arm, wherein said elongated member is separate from said resistance means.

2. The exercise machine according to claim 1 wherein said bar is adjustably attached to said arm.

3. The exercise machine according to claim 1 wherein:

said bar is located at a distance from said shaft; and said bar and said arm include means for selectively adjusting the distance between said bar and said shaft.

4. The exercise machine according to claim 1 wherein said bar has cushioning material attached thereto.

5. The exercise machine according to claim 1 wherein said elongated member has cushioning material attached thereto.

6. The exercise machine according to claim 1 wherein said seat is adjustably attached to said frame.

7. The exercise machine according to claim 1 wherein:

said seat is located at a distance from said shaft; and said seat and said frame include means for selectively adjusting the distance between said seat and said shaft.

8. The exercise machine according to claim 1, wherein said means for providing a rotational resistance to said arm comprises:

a weight supported by said frame;

a cable having a first end and a second end, said first end of said cable being fixed to said weight;

at least one pulley supported by said frame, said cable being routed around said at least one pulley; and a cam fixed to said shaft, said cam having an outer perimeter, said second end of said cable being fixed to said cam, whereby as the individual rotates the ankle so that the foot moves towards the knee while the heel rests on said shaft and the top portion of the foot engages said bar, more of said cable is taken up around said outer perimeter of said cam resulting in said weight being lifted.

9. The exercise machine according to claim 1, wherein said means for providing a rotational resistance to said arm comprises:

a vertical stack of a plurality weight plates supported by said frame, each of said plates having a central hole such that when said plurality of weight plates are vertically stacked a vertical passage is formed through said vertical stack, each of said plurality of weight plates having a channel in the bottom thereof communicating with said vertical passage;

a lifter rod vertically positionable to lie at least in part within said vertical passage, said lifter rod having a plurality of holes, a selected one of said plurality of holes being registrable with said channel of a selected one of said plurality of weight plates;

a selector pin engaged to said selected one of said plurality of holes, whereby when said lifter rod is lifted said selected one of said plurality of weight plates and all said plurality of weight plates above said selected one of said plurality of weight plates are lifted with said lifter rod;

a cable having a first end and a second end, said first end of said cable being fixed to said lifter rod;

at least one pulley supported by said frame, said cable being routed around said at least one pulley; and a cam fixed to said shaft so as to rotate therewith, said cam having an outer perimeter, said second end of said cable being fixed to said cam, said cam having a track confining a portion of said cable in contact with said cam to said outer perimeter of said cam, whereby as the individual rotates the ankle so that the foot moves towards the knee while the heel rests on said shaft and the top portion of the foot engages said bar, more of said cable is taken up around said outer perimeter of said cam resulting in said lifter rod being lifted.

10. An anterior tibialis muscle exercise machine, said exercise machine comprising:

a frame a seat supported by said frame;

a shaft rotatably supported by said frame, said shaft being spaced from said seat to permit a user sitting on said seat to place a heel on said shaft;

a memeber affixed to and extending from said shaft;

an elongated member having a first end pivotally to said frame and an opposite second end including a handle for use by an exerciser seated in said seat, said elongated member being connected to said member so as a to rotate said shaft upon pivoting of said elongated member by an exercise;

an arm fixed to said shaft so as a to rotate therewith;

a bar supported by said arm, said bar being parallel to and spaced apart from said shaft for a user to engage said bar with a top portion of a foot with the heel resting on said shaft; and means for providing a resistance to said arm rotating while a user rests a heel on said shaft, with a forward top portion of the foot engaging said bar, and rotates the ankle so that the forward top portion of the foot moves the knee, wherein said elongated member is seperate from said resistance means.

11. The exercise machine according to claim 10, wherein said means for providing a resistance includes:

a vertical stack of a plurality weight plates supported by said frame, each of said plates having a central hole such that when said plurality of weight plates are vertically stacked a vertical passage is formed through said vertical stack, each of said plurality of weight plates having a channel in the bottom thereof communicating with said vertical passage;

a lifter rod vertically positionable to lie at least in part within said vertical passage, said lifter rod having a plurality of holes, a selected one of said plurality of holes being registrable with said channel of a selected one of said plurality of weight plates;

a selector pin engaged to said selected one of said plurality of holes, whereby when said lifter rod is lifted said selected one of said plurality of weight plates and all said plurality of weight plates above said selected one of said plurality of weight plates are lifted with said lifter rod;

a cable having a first end and a second end, said first end of said cable being fixed to said lifter rod;

at least one pulley supported by said frame, said cable being routed around said at least one pulley; and a cam fixed to said shaft so as to rotate therewith, said cam having an outer perimeter, said second end of said cable being fixed to said cam, said cam having a track confining a portion of said cable in contact with said cam to said outer perimeter of said cam, whereby as the user rotates the ankle so that the foot moves towards the knee while the heel rests on said shaft and the top portion of the foot engages said bar, more of said cable is taken up around said outer perimeter of said cam resulting in said lifter rod being lifted.

* * * * *